US008186274B2

(12) United States Patent
Van Stratum

(10) Patent No.: US 8,186,274 B2
(45) Date of Patent: May 29, 2012

(54) FLUID ENERGY DELIVERY BURST CARTRIDGE

(75) Inventor: Bruce G. Van Stratum, Tallahassee, FL (US)

(73) Assignee: Martin Electronic, Perry, FL (US)

( * ) Notice: Subject to any disclaimer, the term of this patent is extended or adjusted under 35 U.S.C. 154(b) by 1192 days.

(21) Appl. No.: 11/810,622

(22) Filed: Jun. 6, 2007

(65) Prior Publication Data

US 2010/0147177 A1 Jun. 17, 2010

(51) Int. Cl.
*F42B 5/26* (2006.01)
*F42B 33/00* (2006.01)

(52) U.S. Cl. ..... 102/470; 102/469; 86/19.5

(58) Field of Classification Search ..... 102/430, 102/440, 464, 469, 470, 443; 86/18, 19.5, 86/19.6, 36

See application file for complete search history.

(56) References Cited

U.S. PATENT DOCUMENTS 3,728,967 A * 4/1973 Hinkle et al. ..... 102/472
3,771,451 A * 11/1973 Woodring ..... 102/430
3,861,309 A * 1/1975 Veber ..... 102/469
3,983,817 A * 10/1976 Tucker ..... 102/513
7,004,074 B2 * 2/2006 Van Stratum ..... 102/470
7,793,591 B1 * 9/2010 Van Stratum ..... 102/443
7,802,520 B2 * 9/2010 Van Stratum ..... 102/490
7,841,279 B2 * 11/2010 Reynolds et al. ..... 102/469

* cited by examiner

*Primary Examiner* — James Bergin

(74) *Attorney, Agent, or Firm* — J. Wiley Horton

(57) ABSTRACT

A modified fluid delivery cartridge. A conventional straight-sided high pressure cartridge case is primed and then filled with solid propellant. A burst cup is inserted in the case mouth. The burst cup is preferably embossed with a cross or other shape to promote predictable rupture. A charge casing is provided which opens into a high pressure cartridge receiver bounded by an inner charge casing wall. The inner charge casing wall is provided with a step, in which the diameter of the high pressure cartridge receiver is reduced. The high pressure cartridge case is pressed into the receiver in the charge casing wall. As the high pressure cartridge case is being pressed into place, the straight wall of the case passes over the step in the inner charge casing wall, which deforms the straight wall to form a neck. This neck captured the burst cup within the high pressure cartridge case.

20 Claims, 11 Drawing Sheets

FLUID ENERGY DELIVERY BURST CARTRIDGE

CROSS-REFERENCES TO RELATED APPLICATIONS

Not Applicable

STATEMENT REGARDING FEDERALLY SPONSORED RESEARCH OR DEVELOPMENT

Not Applicable.

MICROFICHE APPENDIX

Not Applicable

BACKGROUND OF THE INVENTION

1. Field of the Invention

This invention relates to the field of propellant gas delivery systems. More specifically, the invention comprises an improved energy delivery cartridge with a burst cup that allows controlled discharge of the propellant gases generated within said cartridge. The invention further comprises a method for forming said improved energy delivery cartridge during an assembly process.

2. Description of the Related Art

Although the present invention can be applied to any application requiring the use of metered propellant gases, it was primarily developed as part of a propellant system for launching 40 mm grenades (such as the U.S. Army's M433). The invention is an improvement to a prior design reduced to practice by the same inventor. The prior design is disclosed and claimed in U.S. Pat. No. 7,004,074 to Van Stratum (2006), which is hereby expressly incorporated by reference.

Metallic cartridges have been used to encapsulate solid propellants for many years. In recent years other materials have been substituted for the traditional brass, but the principles of operation remain the same: A projectile is seated in the open mouth of a cartridge case containing solid propellant. Ignition of the propellant is provided by percussive or electrical means. The burning propellant generates pressurized gas which forces the projectile out of the mouth of the case and then typically through a barrel bore.

The launching of a 40 mm grenade involves the same principles. The main difference, however, is the size and mass of the projectile. A typical shoulder-fired military weapon launches a projectile weighing less than 30 grams at a relatively high velocity (700-1,000 meters per second). In contrast, a 40 mm grenade weapon launches a projectile weighing over 200 grams at a relatively low velocity (70-80 meters per second). Thus, while the operating principles between the two types of weapons are the same, they can be said to operate in different regimes.

Since the human operator can only withstand a fixed amount of recoil, one cannot merely scale up the cartridge of a shoulder-fired rifle and create a useable weapon for launching 40 mm grenades. The design considerations are different. The incorporated U.S. Pat. No. 7,004,074 illustrates and describes an effective approach to the problem of launching large masses at low velocities. The '074 invention uses a high-pressure cartridge embedded within a low-pressure larger cartridge. A burst cup metering system is used to meter propellant gases from the high pressure cartridge into the low pressure cartridge, thereby accelerating the projectile in a smooth and controlled fashion. This approach helps to reduce the peak recoil loads experienced by a user. The high pressure found within the high pressure cartridge also ensures the reliable ignition and combustion of the propellant it contains.

The present invention seeks to simplify the construction and assembly of a suitable High-Low gas pressure cartridge. Although the illustrations and descriptions pertain to 40 mm grenade launchers, the reader should bear in mind that the invention applies to many fields beyond military munitions. A good example is disclosed in U.S. Pat. No. 6,189,926 to Smith (2001), which uses a High-Low pressure cartridge to inflate an airbag. Additional applications would include, without limitation:

1. Turbine and piston engine starters;
2. Parachute inflation devices;
3. Mechanical deployment device;
4. Life vest inflation devices;
5. Life boat inflation devices; and
6. Explosive bolt cutting devices.

BRIEF SUMMARY OF THE INVENTION

The present invention is a modified fluid delivery cartridge. FIGS. 2 and 3 illustrate most of the invention's features. FIG. 2 shows a projectile assembly using a High-Low gas pressure cartridge to launch projectile 14. High pressure chamber 31 is formed within high pressure cartridge 42. Low pressure chamber 30 is formed within low pressure cartridge 38. Burst cup 46 closes the open mouth of the high pressure cartridge. The burst cup is preferably embossed with rupture lines so that it ruptures in a predictable fashion when the high pressure cartridge is ignited.

FIG. 3 shows the high pressure cartridge in greater detail. High pressure cartridge wall 61 is preferably surrounded and reinforced by charge casing 28 (which is a part of the low pressure cartridge). The charge casing includes step 44, which is a region in which the charge casing's inner surface narrows to a smaller diameter. High pressure cartridge wall 61 is deformed to follow the step, resulting in a neck 78. The neck retains the burst cup in place when it is fired.

The neck in the high pressure cartridge wall is preferably created when the high pressure cartridge is pressed into the low pressure cartridge. The high pressure cartridge wall actually starts as a conventional straight wall. As the high pressure cartridge is pressed into the low pressure cartridge, step 44 actually creates the neck in the high pressure cartridge wall.

REFERENCE NUMERALS IN THE DRAWINGS

| | | | |
|---|---|---|---|
| 11 | projectile assembly | 12 | low pressure cartridge |
| 14 | projectile | 16 | rifling ring |
| 22 | extraction flange | 24 | base |
| 25 | high pressure cartridge receiver | | |
| 28 | charge casing | 30 | low pressure chamber |
| 31 | high pressure chamber | 34 | percussion primer |
| 36 | propellant | 38 | low pressure cartridge wall |
| 40 | projectile base | 42 | high pressure cartridge |
| 44 | step | 46 | burst cup |
| 48 | embossed lines | 52 | charge vent hole |
| 54 | burst petal | 56 | expansion nozzle |
| 60 | bulkhead | 61 | high pressure cartridge wall |
| 63 | high pressure cartridge base | 65 | inner charge casing wall |
| 67 | ram | 78 | neck |
| 80 | low volume curve | 82 | high volume curve |

DETAILED DESCRIPTION OF THE INVENTION

Figure 1:
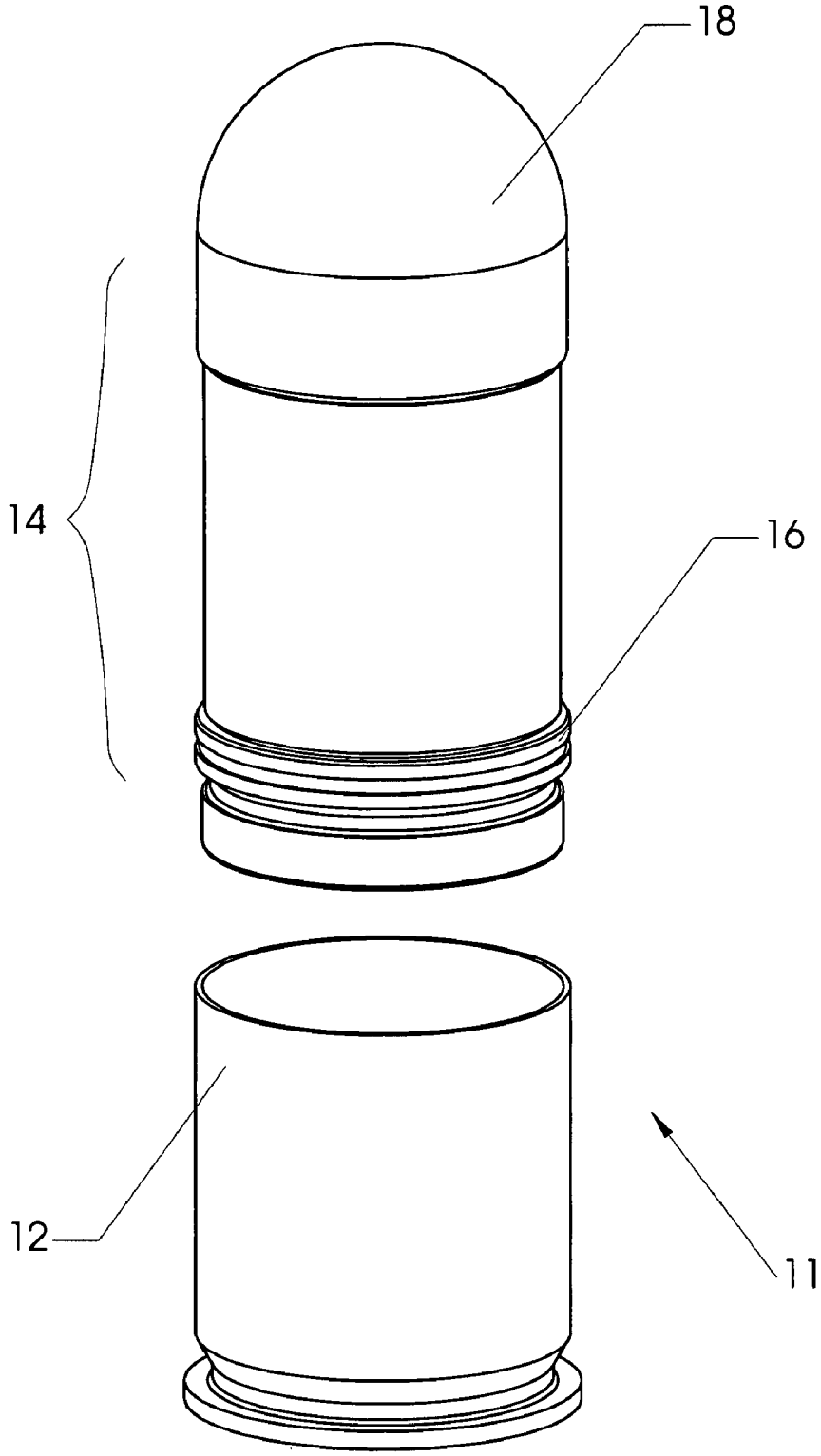
FIG. 1 is an exploded perspective view, showing a projectile assembly.

FIG. 1 shows the major components of a 40 mm grenade round. Projectile 14 is mated with low pressure cartridge 12 to form projectile assembly 11. Those skilled in the art will know that projectile 14 can assume many forms, including a fragmentation grenade, a smoke round, a flare round, etc. It generally includes a rifling ring 16 sized to engage the rifling on the bore of the grenade launching weapon. Nose cone 18 provides an aerodynamically efficient shape.

Figure 2:
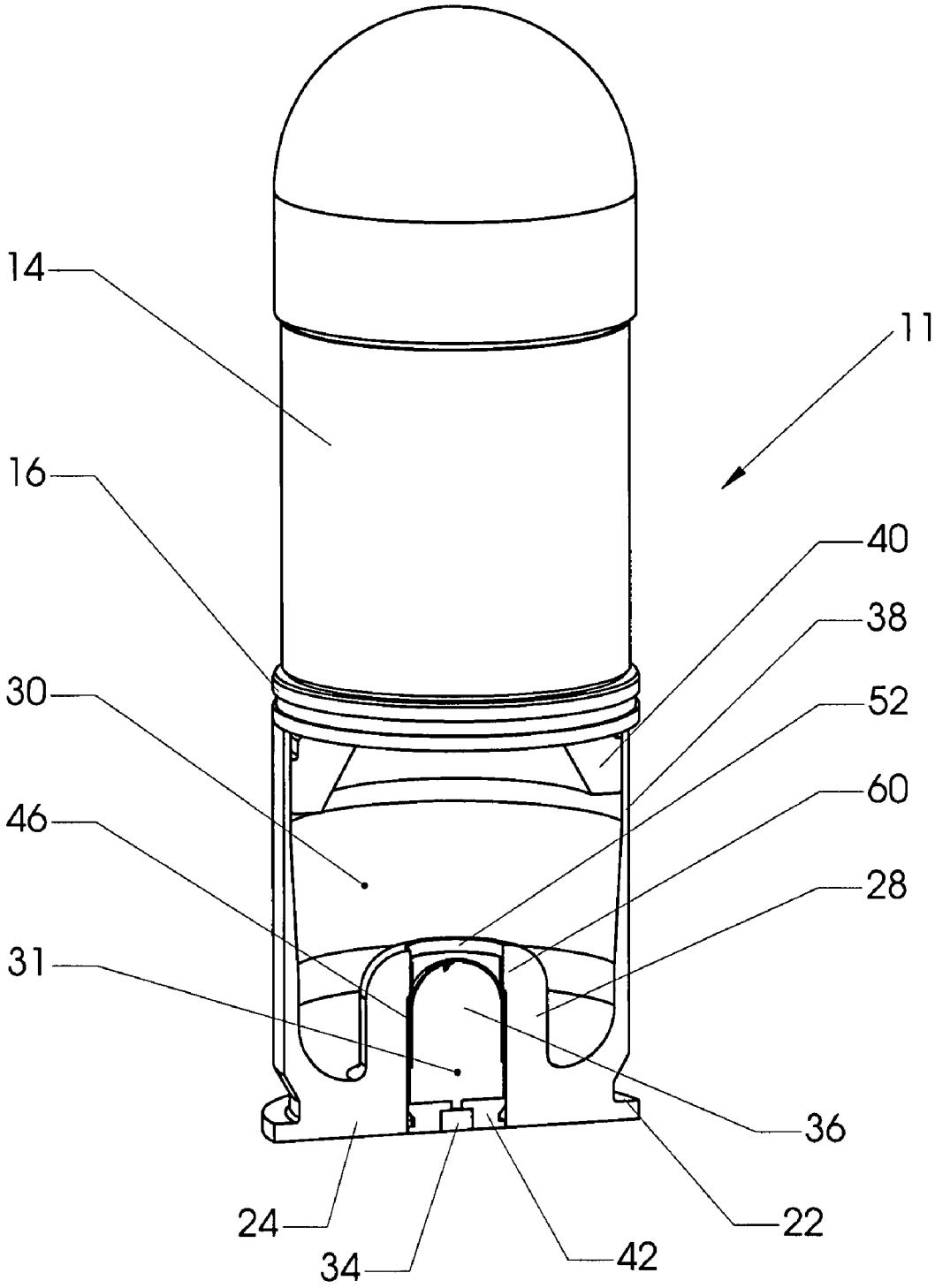
FIG. 2 is a perspective view with a cutaway, showing internal details of the High-Low cartridge.

FIG. 2 shows projectile assembly 11 with a cutaway through low pressure cartridge 12 to reveal its internal details. The reader will observe that high pressure cartridge 42 is located in the base 24 of low pressure cartridge 12. It is surrounded and reinforced by charge casing 28. Bulkhead 60 lies over the top of the high pressure cartridge. It opens into charge vent hole 52.

The high pressure cartridge is preferably closed via a burst cup 46. The high pressure cartridge contains a quantity of propellant 36, which is ignited by striking percussion primer 34. Thus, the burst cup divides the assembly into high pressure chamber 31 (within the high pressure cartridge) and low pressure chamber 30 (the enclosure formed by base 24, low pressure cartridge wall 38, and projectile base 40). When the percussion primer is struck, it ignites the propellants within the high pressure cartridge and ruptures burst cup 46. The burst cup then forms an expansion nozzle which meters the hot propellant gases from the high pressure chamber into the low pressure chamber.

Figure 3:
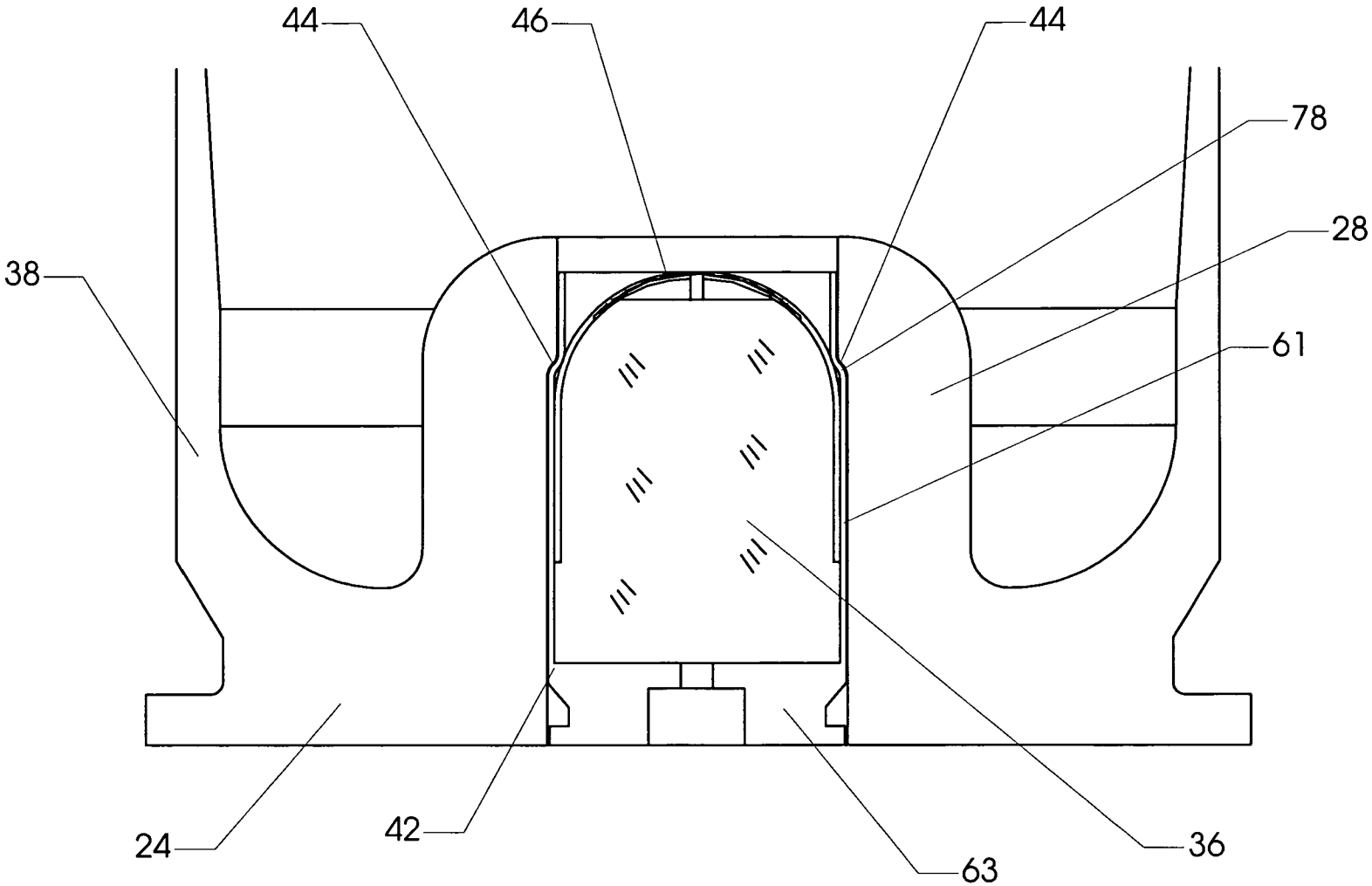
FIG. 3 is a sectioned elevation view, showing details of the charge casing and high pressure cartridge wall.

FIG. 3 shows the high pressure cartridge in greater detail. The cartridge case preferably assumes the form of a conventional pistol cartridge—such as the .38 Automatic Colt Pistol ("ACP") or the .45 ACP. The high pressure cartridge has high pressure cartridge base 63 and a cylindrical high pressure cartridge wall 61 attached thereto. The open end of the cartridge is closed by the insertion of burst cup 46. Burst cup 46 is held in position by neck 78 in high pressure cartridge wall 61.

Figure 3B:
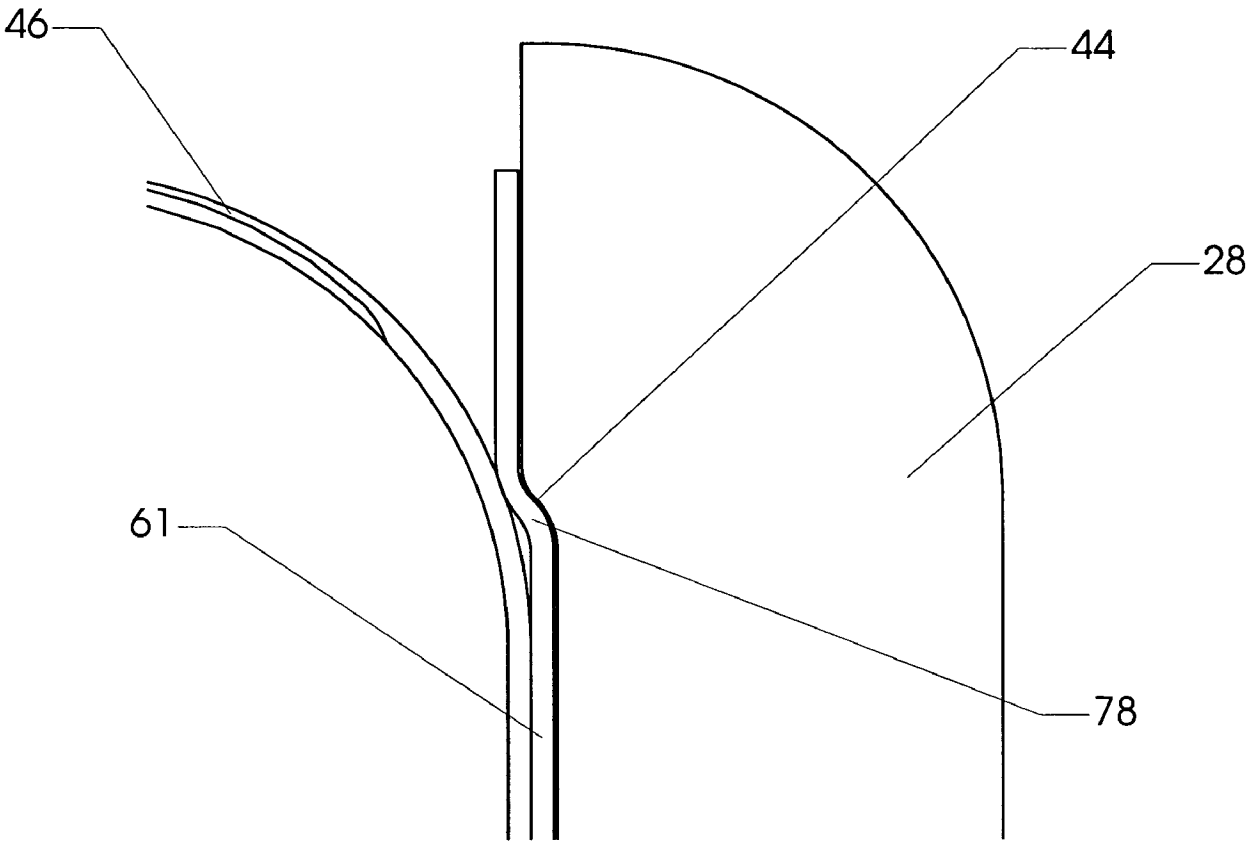
FIG. 3B is an elevation view, showing how the step in the charge casing forms the neck in the cartridge wall.

Turning briefly to FIG. 3B, the reader will observe that the inward facing wall of charge casing 28 includes step 44, which is positioned to bear against neck 78. Returning now to FIG. 3, the reader will appreciate how neck 78 retains burst cup 46 in position, and how step 44 reinforces neck 78. The high pressure cartridge contains a suitable quantity of propellant 36, which is ignited by percussion primer 63 in a manner well known in the art.

Figure 4:
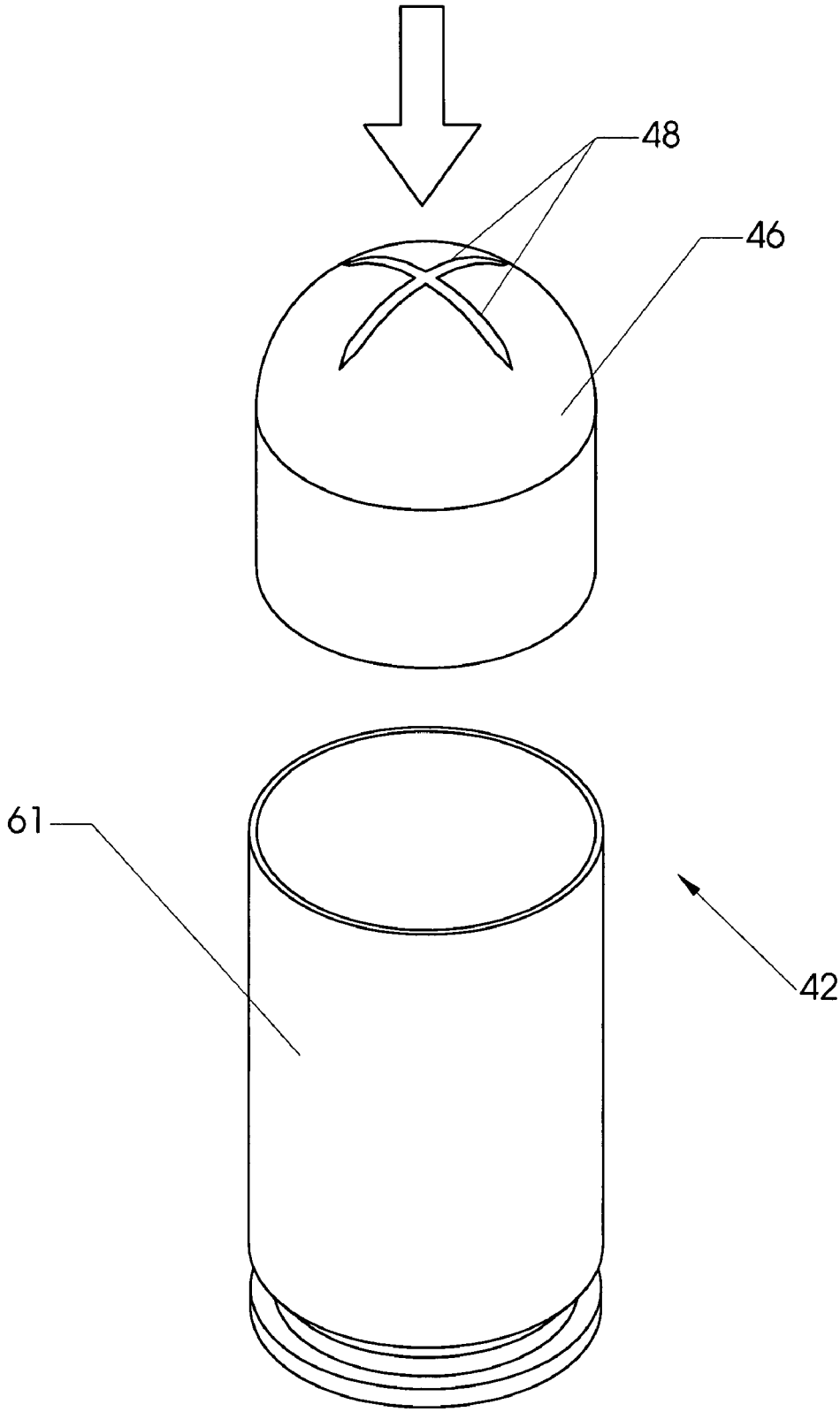
FIG. 4 is an exploded perspective view, showing how the burst cup is pressed into the high pressure cartridge wall.
Figure 5:
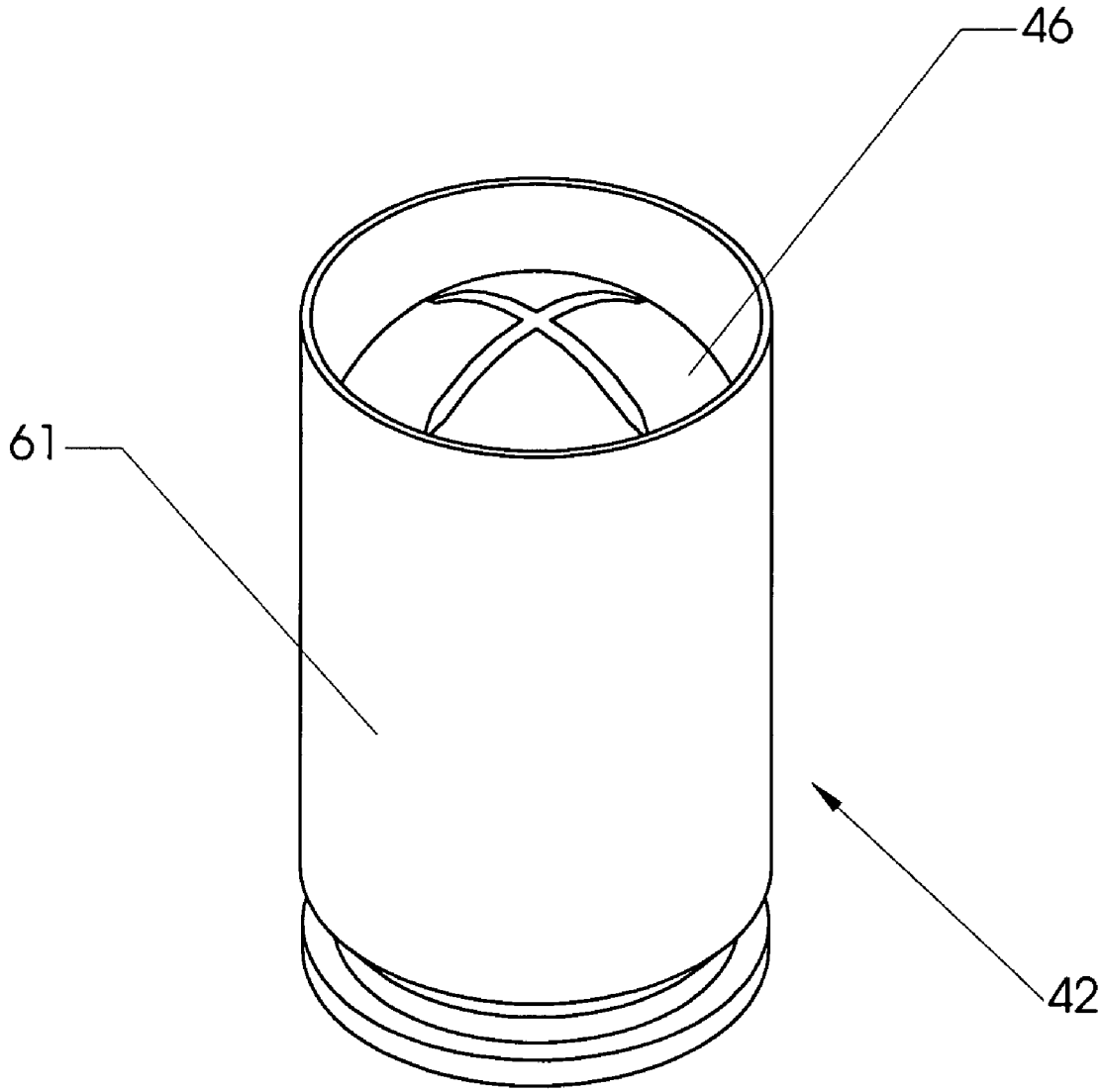
FIG. 5 is a perspective view, showing the components of FIG. 4 in an assembled state.

FIGS. 4 and 5 illustrate how the high pressure cartridge is loaded and assembled. First, a percussion primer is pressed into the cartridge base. Then a suitable amount of propellant (such as M9 ball powder) is placed into the open mouth of the cartridge case. Next—as shown in FIG. 4—burst cup 46 is slipped into the open mouth of the case, over the top of the propellant. The reader will observe that one end of the burst cup is cylindrical. The outward facing surface of this cylindrical portion is a sliding fit within the inward facing surface of high pressure cylinder wall 61.

FIG. 5 shows burst cup 46 pressed into position. The top of the burst cup preferably includes a pattern of embossed lines 48. These weaken the dome of the burst cup so that it will rupture in a predictable fashion. It is also preferable to seat the burst cup a fixed distance into the cartridge. This can be done with a seating fixture. However, if a propellant of appropriate density is used, the propellant charge itself can properly locate the burst cup. Once the burst cup has expelled the air in the cartridge and pressed against the solid propellant, it will go no further.

The assembly shown in FIG. 5 is ready to be completed by adding the neck in the high pressure cartridge wall. Assuming that the cartridge wall is made of a reasonably ductile material—such as brass—this operation can be done by a conventional forming die. However, if the components are properly configured, the low pressure cartridge case itself can serve as a sort of forming die. Since this eliminates a step in the manufacturing process, it represents the preferred embodiment.

Figure 6:
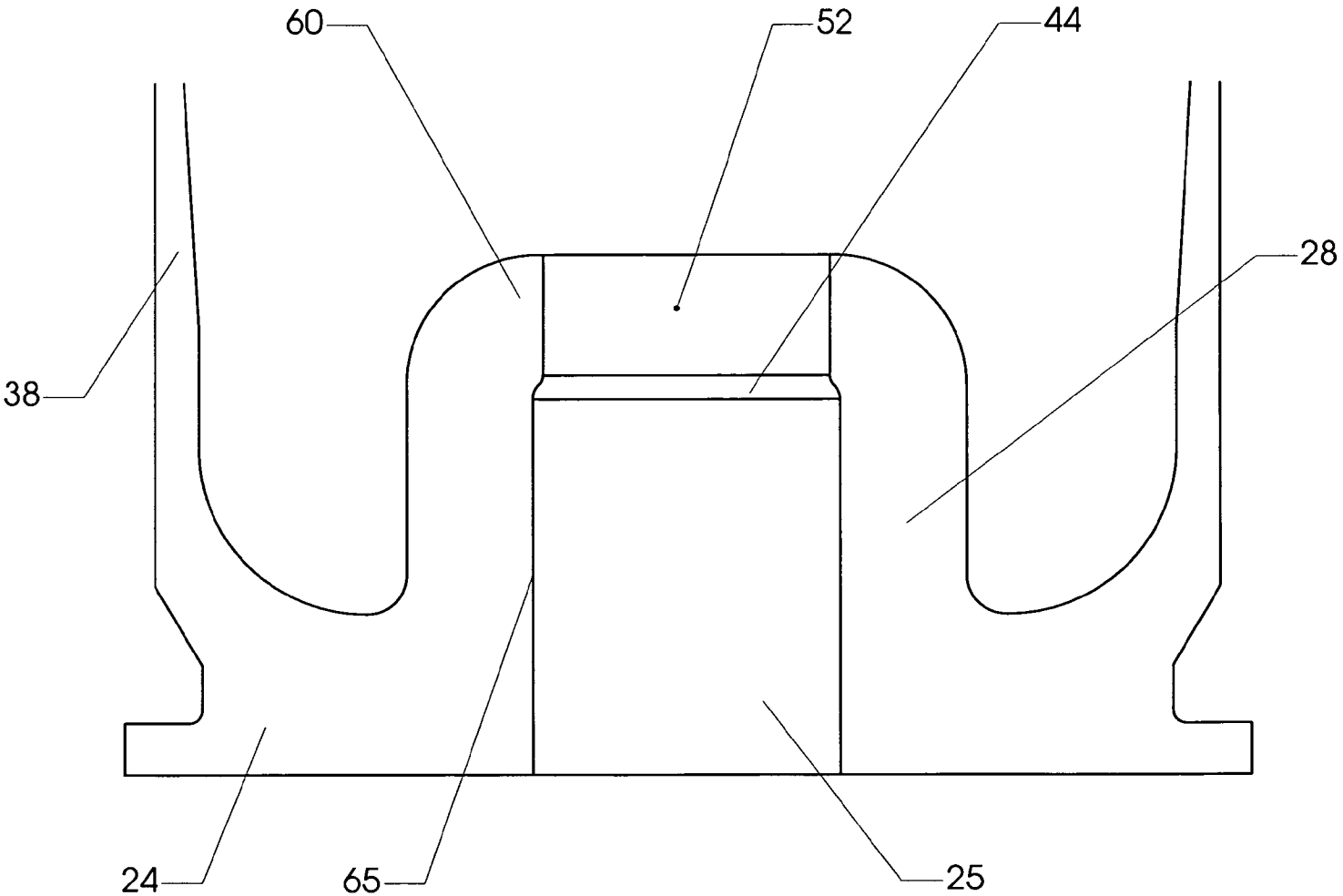
FIG. 6 is a sectioned elevation view, showing details of the step in the inner charge casing wall.

FIG. 6 shows base 24 of low pressure cartridge 12 in more detail. Base 24 opens into high pressure cartridge receiver 25. The high pressure cartridge receiver is surrounded by charge casing 28 and bulkhead 60. The inward facing wall of the charge casing is designated as inner charge casing wall 65. The reader will observe that the diameter of the inner charge casing wall is abruptly reduced in the region of step 44, resulting in the transition to charge vent hole 52. The step can take many forms, including a simple fillet radius (as shown) or an angled chamfer. It could also simply be a sharp-edged step, though this is not preferable for reasons which will become apparent.

Figure 7:
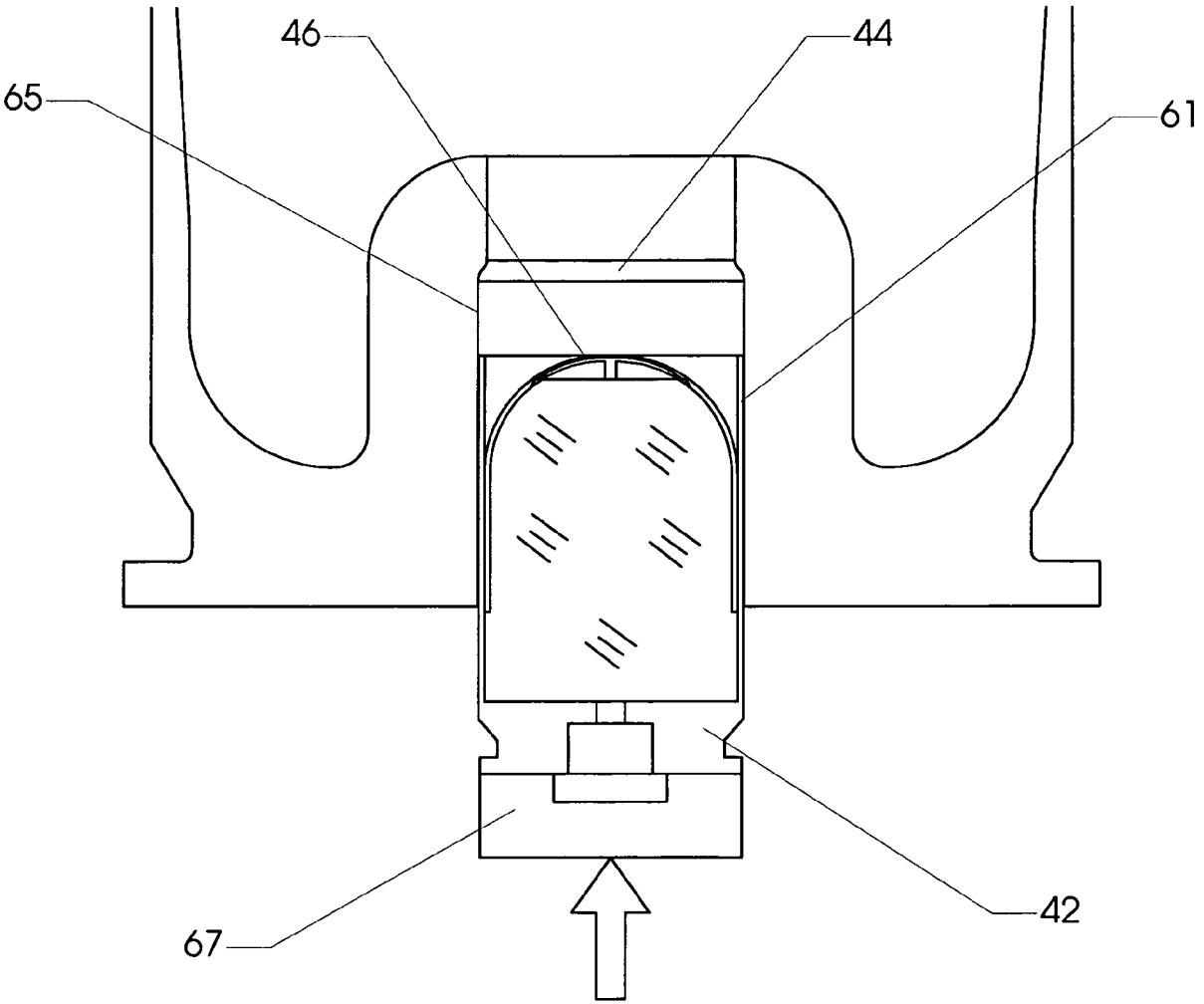
FIG. 7 is a sectioned elevation view, showing the pressing of the high pressure cartridge into the low pressure cartridge.
Figure 8:
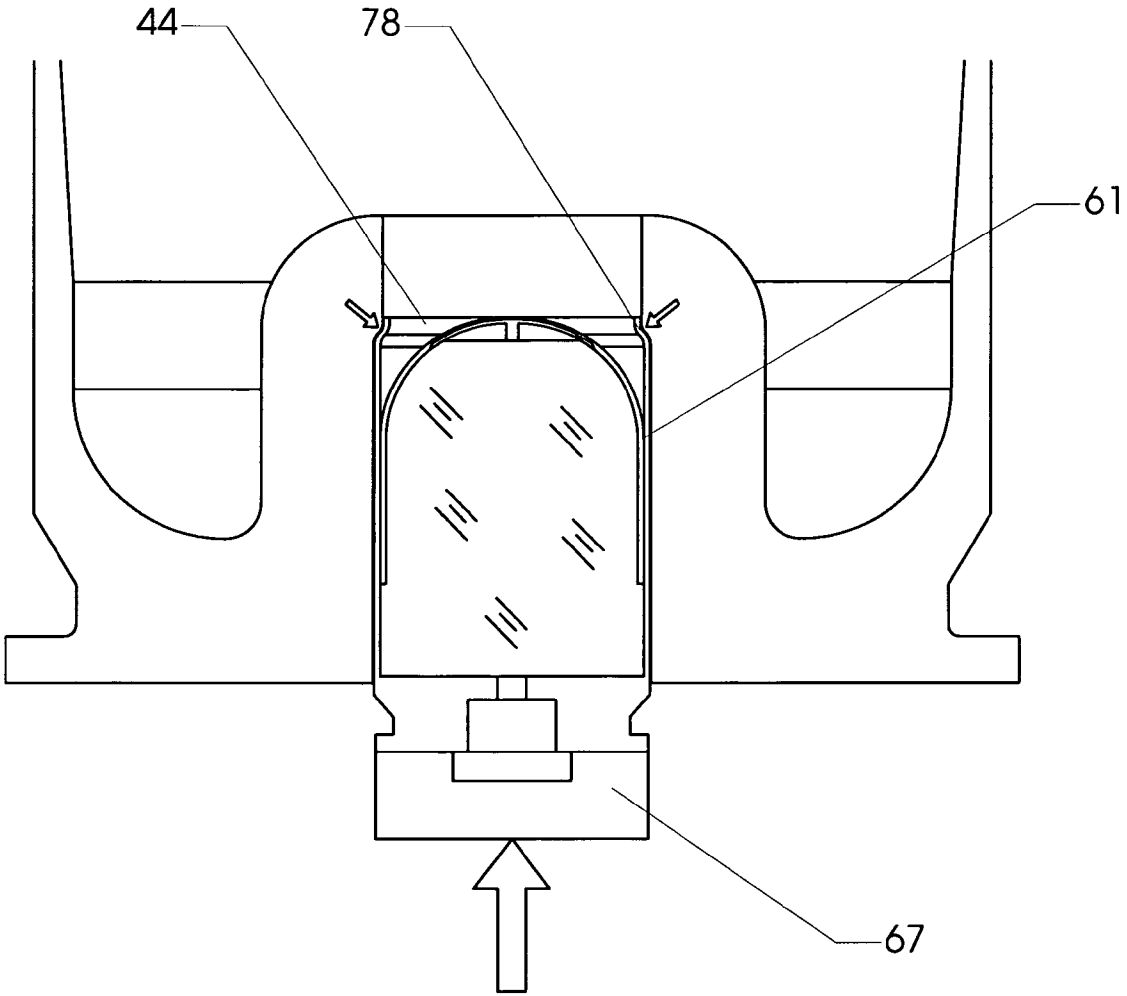
FIG. 8 is a sectioned elevation view, showing the pressing of the high pressure cartridge into the low pressure cartridge.

The inner charge casing wall, the step, and the charge vent hole preferably act as a sort of forming die when the high pressure cartridge is placed into the low pressure cartridge. FIGS. 7 and 8 illustrate this process. In FIG. 7, high pressure cartridge 42 is being forced into the high pressure cartridge receiver using a suitable tool. Ram 67 forces the high pressure cartridge into the receiver without placing pressure on the percussion cap. The reader will note in FIG. 7 that high pressure cartridge wall 61 is undeformed. It is simply advancing along the cylindrical portion of inner charge casing wall 65.

In FIG. 8, the high pressure cartridge has been pressed further into the receiver in the low pressure cartridge. The reader will observe how neck 44 has deformed high pressure cartridge wall 61 inward to form neck 78. As the insertion continues, the ductile wall material of the high pressure cartridge will continue to flow over step 44 and neck 78 will move lower and lower with respect to the base of the high pressure cartridge. When the cartridge is fully seated, it will assume the appearance shown in FIG. 3. Thus, the reader will appreciate how the high pressure cartridge has been advantageously altered during its assembly into the low pressure cartridge.

Looking still at FIG. 3, the reader will note how the step in the charge casing wall bears against and reinforces the neck in the low pressure cartridge case, holding the high pressure case firmly in position. Of course, the high pressure case may tend to back out of the low pressure case upon firing (move downward in the orientation shown in the view). For this reason, it is preferable to deform some portion of the low pressure cartridge case into the extractor groove surrounding the base of the high pressure cartridge case. This can be done by peening or other suitable processes. The same techniques are preferably applied to the percussion primer so that it will not back out of the high pressure cartridge case.

Figure 9:
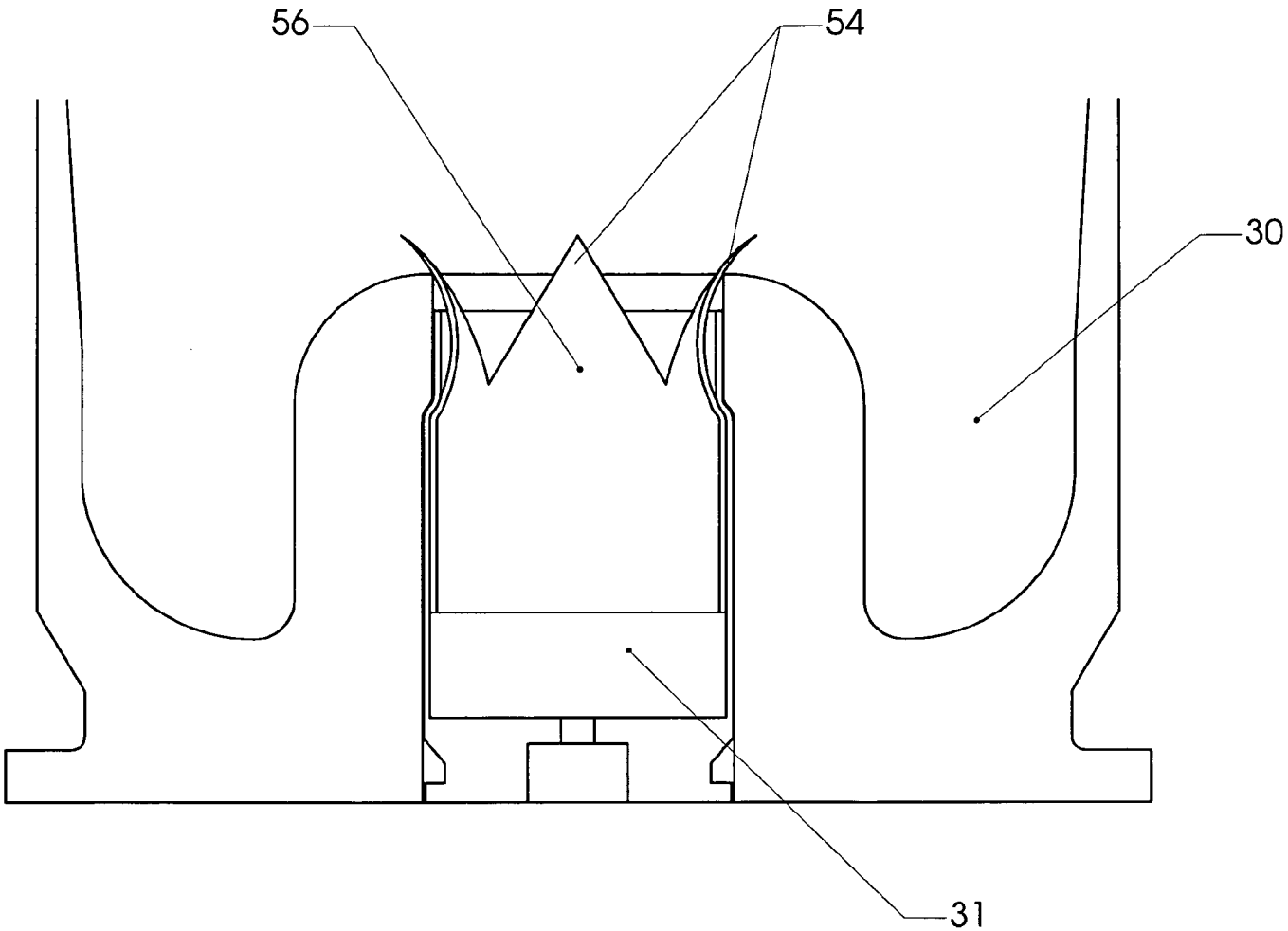
FIG. 9 is a sectioned elevation view, showing the high pressure cartridge after it has ignited and expelled its propellant.

When the high pressure cartridge case is detonated, the burst cup ruptures and meters the propellant gases into the low pressure chamber. FIG. 9 shows a sectioned elevation view after the cartridge has detonated. The hemispherical portion of burst cup 46 has fractured into a plurality of burst petals 54. Expansion nozzle 56 has thereby been formed between high pressure chamber 31 and low pressure chamber 30. The interference between the neck in the high pressure cartridge case and the step in the charge casing wall has retained the high pressure cartridge and the burst cup in position.

Although the neck is preferably formed when the high pressure cartridge is inserted into the low pressure cartridge, this is by no mean the invention's only embodiment. The neck could obviously be formed in a separate die and the formed case could then be inserted into the high pressure case receiver. The function of the completed device would then be the same.

The amount of gas volume contained within the low pressure chamber prior to ignition of the high pressure cartridge has a significant impact on the recoil forces generated. FIG. 2 shows the free volume trapped between the base of the projectile and the inward facing walls of the low pressure cartridge. Those skilled in the art will realize that design variations could easily alter this volume. As one example, reducing the length of low pressure cartridge 38 would reduce the free volume.

Greater volume tends to prevent a rapid rise in pressure within the low pressure chamber, which in turn tends to spread the recoil forces generated out over a longer period of time. Of course, the low pressure chamber volume enlarges once the projectile starts moving down the bore. However, rifling ring 36 largely seals the gap between the projectile and the bore, so that the projectile acts like a gas-driven piston.

The presence of a large volume in the low pressure chamber prior to the point where the projectile begins to move tends to act as an energy absorber which prevents a rapid spike in gas pressure. This will tend to reduce the peak low pressure chamber pressure experienced during firing. This reduction in peak low pressure chamber pressure will also reduce peak recoil forces experienced by the person firing the weapon.

Figure 10:
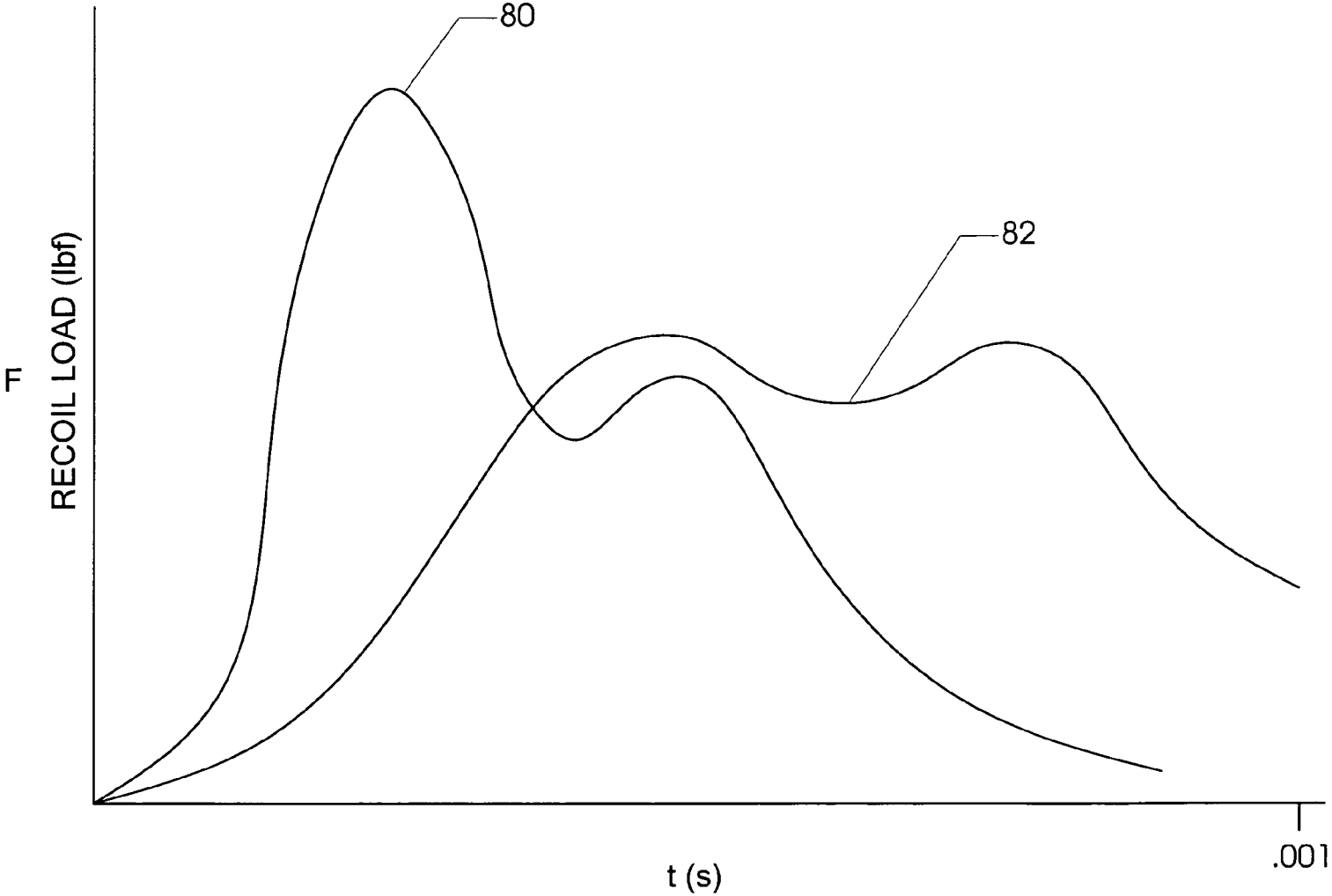
FIG. 10 is a graph of recoil load versus time, during a single firing cycle.

FIG. 10 provides some explanation of this phenomenon. FIG. 10 shows two test firings, one using a relatively low initial gas volume within the low pressure chamber and one using a relatively high volume. The Y-axis shows recoil force in pounds (lbf). The X-axis shows time (in seconds). Low volume curve 80 plots the force experienced during a test using a low free volume in the low pressure chamber. High volume curve 82 is the same test using a large free volume in the low pressure chamber.

The area under each curve represents the impulse imparted to each projectile. The area under each curve is very nearly equal, which must be true if the two projectiles are to achieve the same muzzle velocity (which is true for the test). However, the reader will observe that the peak recoil load for the high volume test is significantly lower. The recoil forces are also experienced over a longer period of time. In subjective terms, the use of a larger free volume in the low pressure chamber has taken a sharp jab and converted it into a longer shove. This shift makes the recoil forces much more tolerable for the shooter.

Although the preceding description contains significant detail, it should not be construed as limiting the scope of the invention but rather as providing illustrations of the preferred embodiment of the invention. Thus, the scope of the invention should be fixed by the following claims, rather than by the examples given.

Having described my invention, I claim:

1. A method for making a cartridge for the controlled delivery of a fluid, comprising:

a. providing a high pressure case, having a closed first end, an open second end, and a continuous side wall running between said first and second ends, thereby defining a hollow interior;

b. providing propellant, contained within said hollow interior of said high pressure case;

c. providing a domed burst cup, having an internal surface and an external surface, and having an open first end and a closed second end thereby defining a hollow interior within said burst cup, with said burst cup being placed within said open second end of said high pressure case;

d. providing a low pressure cartridge, said low pressure cartridge including a high pressure cartridge receiver having an inner charge casing wall;

e. providing a step in said inner charge casing wall; and f. forcing said high pressure case and said domed burst cup into said high pressure cartridge receiver so that said continuous side wall of said high pressure case slides against said inner charge casing wall and is deformed as said continuous side wall passes over said step to form a neck in said continuous side wall which laps over said external surface of said domed burst cup, thereby trapping said burst cup in said high pressure case.

2. A method for making a cartridge as recited in claim 1, further comprising plastically deforming a portion of said charge casing in order to create an interference fit with said high pressure case, thereby retaining said high pressure case in said charge casing.

3. A method for making a cartridge as recited in claim 1, wherein said step of providing propellant comprises providing an amount of propellant which fills substantially all of the volume enclosed by said high pressure case and said internal surface of said burst cup.

4. A method for making a cartridge as recited in claim 3, further comprising plastically deforming a portion of said high pressure cartridge receiver in order to create an interference fit between said high pressure cartridge receiver and said high pressure case, thereby retaining said high pressure case in said high pressure cartridge receiver.

5. A method for making a cartridge for the controlled delivery of a fluid as recited in claim 1, wherein said burst cup is embossed so as to rupture into a plurality of approximately uniform petals.

6. A method for making a cartridge as recited in claim 5, further comprising plastically deforming a portion of said high pressure cartridge receiver in order to create an interference fit between said high pressure cartridge receiver and said high pressure case, thereby retaining said high pressure case in said high pressure cartridge receiver.

7. A method for making a cartridge as recited in claim 1, wherein said step in said inner charge casing wall includes a fillet radius.

8. A method for making a cartridge as recited in claim 7, further comprising plastically deforming a portion of said high pressure cartridge receiver in order to create an interference fit between said high pressure cartridge receiver and said high pressure case, thereby retaining said high pressure case in said high pressure cartridge receiver.

9. A method for making a cartridge as recited in claim 1, wherein said step in said inner charge casing wall includes an angled chamfer.

10. A method for making a cartridge as recited in claim 9, further comprising plastically deforming a portion of said high pressure cartridge receiver in order to create an interference fit between said high pressure cartridge receiver and said high pressure case, thereby retaining said high pressure case in said high pressure cartridge receiver.

11. A method for making a cartridge as recited in claim 1, further comprising plastically deforming a portion of said high pressure cartridge receiver in order to create an interference fit between said high pressure cartridge receiver and said high pressure case, thereby retaining said high pressure case in said high pressure cartridge receiver.

12. A method for making a cartridge for the controlled delivery of a fluid, comprising:

a. providing a low pressure cartridge, including a high pressure cartridge receiver bounded at least in part by an inner charge casing wall;

b. providing a step in said inner charge casing wall;

c. providing a high pressure case, having a closed first end, an open second end, and a continuous side wall running between said first and second ends, thereby defining a hollow interior;

d. providing propellant, contained within said hollow interior of said high pressure case;

e. providing a domed burst cup, having an internal surface and an external surface, and having an open first end and a closed second end thereby defining a hollow interior within said burst cup, with said burst cup being placed within said open second end of said high pressure case; and f. forcing said high pressure case and said domed burst cup into said high pressure cartridge receiver so that said continuous side wall of said high pressure case slides against said inner charge casing wall and is deformed as said continuous side wall passes over said step to form a neck in said continuous side wall which laps over said external surface of said domed burst cup, thereby trapping said burst cup in said high pressure case.

13. A method for making a cartridge as recited in claim 12, further comprising plastically deforming a portion of said charge casing in order to create an interference fit with said high pressure case, thereby retaining said high pressure case in said charge casing.

14. A method for making a cartridge as recited in claim 12, wherein said step of providing propellant comprises providing an amount of propellant which fills substantially all of the volume enclosed by said high pressure case and said internal surface of said burst cup.

15. A method for making a cartridge as recited in claim 14, further comprising plastically deforming a portion of said high pressure cartridge receiver in order to create an interference fit between said high pressure cartridge receiver and said high pressure case, thereby retaining said high pressure case in said high pressure cartridge receiver.

16. A method for making a cartridge for the controlled delivery of a fluid as recited in claim 12, wherein said burst cup is embossed so as to rupture into a plurality of approximately uniform petals.

17. A method for making a cartridge as recited in claim 16, further comprising plastically deforming a portion of said high pressure cartridge receiver in order to create an interference fit between said high pressure cartridge receiver and said high pressure case, thereby retaining said high pressure case in said high pressure cartridge receiver.

18. A method for making a cartridge as recited in claim 12, wherein said step in said inner charge casing wall includes a fillet radius.

19. A method for making a cartridge as recited in claim 12, wherein said step in said inner charge casing wall includes an angled chamfer.

20. A method for making a cartridge as recited in claim 12, further comprising plastically deforming a portion of said high pressure cartridge receiver in order to create an interference fit between said high pressure cartridge receiver and said high pressure case, thereby retaining said high pressure case in said high pressure cartridge receiver.

* * * * *